United States Patent [19]

Hansel et al.

[11] 4,033,389

[45] July 5, 1977

[54] INTERLOCK AND LATCHING SYSTEMS FOR A DISPENSING NOZZLE

[75] Inventors: William B. Hansel, Media; Myrl A. Lindeman, Newtown Square, both of Pa.

[73] Assignee: Suntech, Inc., St. Davids, Pa.

[22] Filed: Feb. 17, 1976

[21] Appl. No.: 656,997

[52] U.S. Cl. ..... 141/207; 141/208

[51] Int. Cl.[2] ..... B65B 31/00; B67C 3/34

[58] Field of Search ..... 141/1, 4, 5, 44, 52, 141/59, 93, 217, 206–209, 290, 346, 347, 392, 383–386; 220/85 VR, 85 VS, 86 R

[56] References Cited

UNITED STATES PATENTS 3,911,973 10/1975 Casteline ..... 141/59

*Primary Examiner*—Houston S. Bell, Jr.
*Attorney, Agent, or Firm*—Donald R. Johnson; J. Edward Hess; William C. Roch

[57] ABSTRACT

An interlock system for use on a conventional gasoline dispensing nozzle with an automatic shut-off system is disclosed. The interlock system includes a valve mounted in the discharge spout and connected to the vent tube so that when the valve is in its open position, the vent tube is open to the inside of the discharge spout. The valve actuation system is designed so that when the nozzle is not properly inserted into the vehicle fillpipe, the valve obtains an open position so that in the event dispensing of gasoline is attempted, the vacuum created in the vent tube by the venturi in the automatic shut-off system causes gasoline which flows down the discharge spout to be drawn into the vent tube, thereby causing the automatic shut-off system to disable the nozzle. The valve actuation system is also designed to act in response to the weight of the nozzle resting on the fillpipe and to provide the latching capability for the nozzle.

7 Claims, 4 Drawing Figures

INTERLOCK AND LATCHING SYSTEMS FOR A DISPENSING NOZZLE

CROSS-REFERENCE TO RELATED APPLICATIONS

This application is related to the copending application entitled "Interlock System For A Gasoline Dispensing Nozzle," Ser. No. 635,189, filed Nov. 25, 1975, by William B. Hansel, the subject matter of which includes a valve actuation system responsive to the weight of the nozzle resting on the fillpipe.

BACKGROUND OF THE INVENTION

This invention relates to nozzles for dispensing gasoline into vehicle fuel tanks and more specifically to an interlock system to prevent dispensing of gasoline until the discharge spout of a nozzle is inserted into the vehicle fuel pipe.

Current environmental regulations require in some areas that gasoline vapors displaced from a vehicle fuel tank while being filled are to be recovered in order to prevent their escape into the atmosphere. As part of these requirements, it is foreseeable that an interlock system may be required at some time in the future to prevent the dispensing of gasoline until the vapor receiving system is in contact with the vehicle fuel tank. Even if such a requirement never materializes, it is still desirable to have such an interlock system to encourage the filling station operator to have the vapor receiving system properly in place against the fillpipe before gasoline is dispensed.

The prior art has shown many designs for providing such an interlock system. One common method is to use a mechanical linkage between the face seal of the vapor receiving system and the automatic shut-off system within the nozzle housing itself. This type of a system tends to become overly complicated and significantly adds to the weight of the nozzle as well as to the cost of construction and maintenance.

Another design used a valve located within the discharge spout and connected to the vent line which leads to the automatic shut-off system in the nozzle housing. This valve is then connected to the vapor receiving system in such a manner that it is closed when the vapor receiving system is not in contact with the vehicle fillpipe, thereby preventing the dispensing of gasoline. While this particular design is capable of working, it has at least one drawback in that the linkage mechanism between the valve and the vapor receiving system can greatly limit the flexibility of the vapor receiving system itself, thereby increasing the possibility of not obtaining a tight seal against the vehicle fillpipe.

Another problem sometimes encountered with having a valve located in the vent line is the trapping of gasoline within the vent line by the valve. Under normal operations, when the tank becomes filled, gasoline is drawn into the vent tube due to the suction created by the venturi, which eventually shuts off the nozzle. After the nozzle shuts off but before it is withdrawn from the fillpipe, sufficient time has elapsed so that most of the gasoline has drained out of the vent line and back into the fillpipe. However, when using the valve located in the vent line, withdrawal of the nozzle from the fillpipe may cause some gasoline to become trapped in the vent line. When the nozzle is then placed in an upright position, the gasoline can drain down into the diaphragm chamber inside the nozzle housing. While in many cases this gasoline trapped inside the nozzle may not create any problems, the potential of malfunctioning still exists. Therefore, it is desirable to not alter the vent line operation any more than is necessary.

Preferably, an interlock system should be designed in a way that does not interfere with the movement of the vapor receiving system so that a tight seal is formed reliably each time the nozzle is inserted into the fillpipe. Also, its design should be simple to permit ease of operation as well as to minimize manufacturing costs.

The actuation mechanism of the interlock system should be designed so that it operates automatically during normal use of the nozzle, but permits manual overriding of the system for filling tanks with unusual fillpipe designs. One system for accomplishing this result is shown in the above noted copending application Ser. No. 635,189, which describes an actuation mechanism activated by the weight of the nozzle itself resting in the end of the fillpipe. It is therefore desirable to use such an actuation mechanism for an interlock system because it operates automatically and permits overriding.

It is therefore desirable to have an interlock system with an interlock and actuation mechanism which meet these considerations with minimal change to the conventional nozzle operation.

SUMMARY OF THE INVENTION

In accordance with a preferred embodiment an interlock system is provided which meets these considerations. The system includes an interlock valve connected with the vent tube inside the discharge spout of the nozzle in such a way that in its closed position the vent line operates in its normal fashion and in its open position the vent line is open to the inside of the discharge spout. When the interlock valve is in its open position, dispensing of gasoline is prevented since the vacuum experienced in the vent tube from the venturi in the nozzle housing causes gasoline to be drawn into the vent tube through the valve, thereby causing the automatic shut-off system to prevent further dispensing of gasoline. The automatic shut-off system operates in its normal fashion when the interlock valve is in its closed position. A construction within the vent line at the location of the interlock valve serves to improve the operation of the valve.

An actuation system having a design similar to that shown in the above noted related application can be used to place the interlock valve in its closed position only when the nozzle is inserted in the fillpipe and resting on the end of the fillpipe. The exact location of the actuation system can be arranged so that the interlock valve achieves a closed position only when the nozzle is inserted far enough into the fillpipe to cause the vapor receiving system to seal against the fillpipe opening.

This particular interlock system provides the advantages that it in no way alters the normal operation of the vent line for the automatic shut-off system and reduces the chances of gasoline being trapped inside the vent line. In the event that the interlock system is used on a nozzle design having a vapor receiving system, this particular interlock system provides the additional advantage that it is actuated solely by the weight of the nozzle resting on the end of the fillpipe and not by any movement of the vapor receiving system, which can interfere with the ability of the vapor receiving system to make a tight seal against the fillpipe.

A better understanding of the invention and its advantages can be seen in the following description of the figures and preferred embodiment.

DESCRIPTION OF THE FIGURES AND PREFERRED EMBODIMENT

Figures 1, 2, 3, 4:
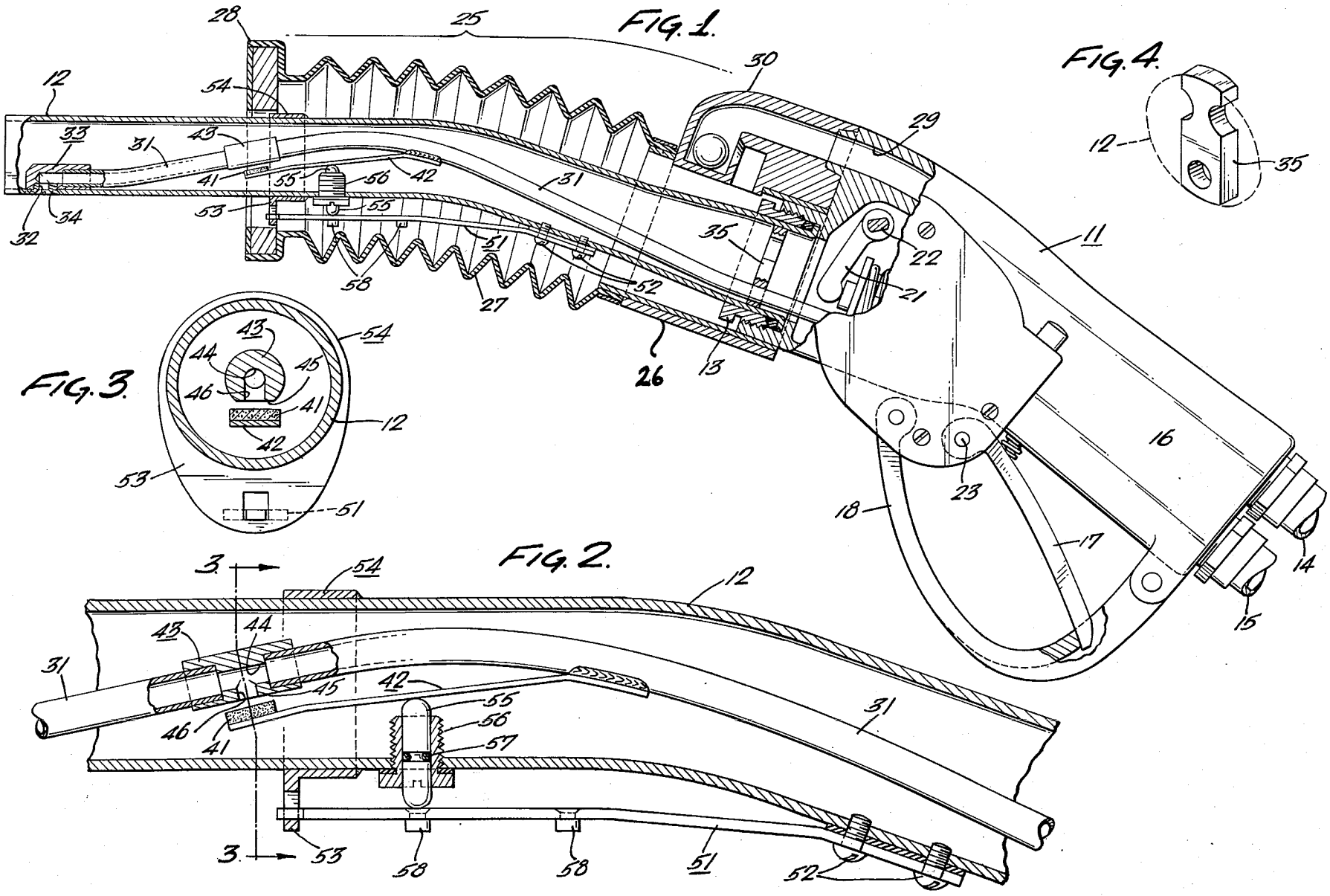
FIG. 1 illustrates a dispensing nozzle with the interlock system according to this invention.
FIG. 2 illustrates the interlock system of FIG. 1 in an enlarged partial sectional view.
FIG. 3 is a partial section along line 3—3 in FIG. 2.
FIG. 4 is a pictorial view of bridge 35 in FIG. 1.

The interlock system described herein can be used on most of the nozzles that are commercially available today and with many of the vapor receiving systems available. However, an ideal nozzle and vapor receiving system, which is lightweight and particularly adaptable to such an interlock system, is that disclosed in U.S. Pat. No. 3,734,339 issued to Young and that disclosed in a copending patent application entitled "Gasoline Dispensing Nozzle With Vapor Receiving System," by Hansel, filed Sept. 2, 1975, Ser. No. 609,761, respectively. Aspects of both are used herein for illustrative purposes.

Referring to FIG. 1, the basic nozzle and vapor receiving components will be discussed first. The nozzle assembly has a housing 11 with a discharge spout 12 connected thereto by retaining nut 13. A vapor return hose 14 and a gasoline hose 15 connect to handle portion 16 of housing 11. Operation of the nozzle is accomplished by squeezing lever 17 against handle 16. Guard 18 acts to protect actuating lever 17 as well as to provide a support for holding the nozzle when it is inserted into the pump housing for storage when not in use.

The components inside the nozzle include a main poppet valve for controlling the flow of gasoline through the nozzle. Rotation of operating arm 21 on shaft 22 toward the main poppet valve causes it to open. Shaft 22 is connected to pivot shaft 23 of lever 17 through an automatic shut-off mechanism (not shown) which prevents gasoline from being dispensed when the liquid level in the container reaches the end of spout 12. The shut-off mechanism can be a pressure responsive diaphragm system, the principles of which are well known. A more detailed explanation of the operation of this system is contained in the patent issued to Young.

A possible design for a vapor receiving system which is used for illustrative purposes and which is similar to that shown in copending patent application entitled "Gasoline Dispensing Nozzle with Vapor Receiving System," Ser. No. 609,760, filed Sept. 2, 1975, will now be described. The vapor receiving system includes a vapor receiving chamber which is generally denoted by the number 25 and comprises three general sections non-flexible housing 26, flexible bellows 27, and magnetic seal section 28. A vapor return passageway 29 extends from non-flexible housing 26, through nozzle housing 11 where it is connected to vapor return line 14.

On the top of housing 26 is an attitude valve, 30, which is in fluid communication with the top of the underground storage tanks (not shown) through vapor return hose 24, and vapor return passageway 29 in nozzle housing 11. Attitude valve 30 is used for preventing the vapors in the underground storage tanks from being displaced back into the atmosphere through vapor receiving chamber 25 when the nozzle is not in use and stored in an upright position on the pump. An attitude valve of similar design and operation is illustrated and discussed in more detail in copending patent application entitled "Attitude Valve For A Gasoline Dispensing Nozzle With A Vapor Receiving System," by Hansel, Ser. No. 609,761, filed Sept. 2, 1975.

Most conventional gasoline dispensing nozzles use a balanced diaphragm shut-off system which acts in response to a pressure differential produced when the fillpipe in the vehicle gasoline tank becomes filled with gasoline. Such a system is also included in the nozzle of the above mentioned Young patent. As illustrated in the drawings vent tube 31 travels through discharge spout 12 from opening 32 to one of the pressure chambers on one side of the shut-off diaphragm (not shown). This side of the chamber is also connected to a venturi arrangement so that the flow of gasoline creates a vacuum on this side of the diaphragm which is relieved by having opening 32 in spout 12 open. However, when opening 32 is closed, such as by gasoline reaching the end of the spout, the vacuum from the venturi causes the shut-off diaphragm to disengage lever 17 so that gasoline can no longer be dispensed.

The interlock system design and its operation will now be discussed. The interlock system consists of two general elements, the interlock valve and the actuation mechanism for the interlock valve.

The interlock valve of this invention is designed to open and close a port or valve seat located on the sidewall of vent tube 31. The preferred design for such an interlock valve is illustrated in more detail in FIG. 2. The interlock valve has a valve head 41, which can be made out of a soft flexible material such as sponge rubber or other similar material. Valve head 41 is mounted on one end of actuation member 42, which is connected to vent tube 31 at the other end in such a manner so that member 42 acts as a flat spring and biases valve head 41 in an open position. The spring action of member 42 is aided by the shape of vent tube 31, which is bowed upward in the middle of spout 12. This bowed shape of vent tube 31 is maintained by the use of vent tube inlet terminal 33, which is connected to spout 12 by screw 34, and support bridge 35, which maintains the vent tube position at the end of the spout connected to nozzle housing 11 without materially hindering the flow through spout 12.

The valve seat of the interlock valve can be a port located in the side of vent tube 31. However, for more reliable operation, the valve seat preferably should be located at a constriction in the vent tube. This constriction helps to increase the vacuum force at the valve seat so that a sufficient quantity of gasoline is drawn into the vent line to cause the automatic shut-off system to terminate dispensing. The constriction, by definition, has a smaller inside cross-sectional area, which requires a smaller amount of gasoline to block the vent tube line. Yet, this constriction has minimal affect on the normal operation of the automatic shut-off system when the fuel tank liquid level reaches the end of spout 12.

The constriction effect is provided by constriction section 43, which is inserted in vent tube 31. Constriction section 43 has a reduced diameter section 44 through which the normal fluid flow in vent tube 31 takes place. A port or valve seat 45 for the interlock valve is connected to reduced diameter section 44 through passageway 46.

Many different ways for actuating the interlock valve can be designed. However, as discussed in more detail in the copending application entitled "Interlock System For A Gasoline Dispensing Nozzle," Ser. No. 635,189, filed Nov. 25, 1975, it would be desirable to use an actuation mechanism which acts in response to the weight of the nozzle itself resting on the end of the vehicle fillpipe. In addition to this actuation mechanism, it would be desirable to have several positions for latching the nozzle in the fillpipe so that the nozzle could properly fit in more different kinds of fillpipes.

Accordingly, the actuation system includes an actuator arm 51 which is bent as illustrated in the figures and secured at one end of spout 12 by screws 52 so that it also acts as a flat spring. The free end of arm 51 passes through an opening in the lower extension 53 of guide collar 54, which permits a predetermined amount of linear displacement by this end of arm 51, toward and away from spout 12. The rest of guide collar 54 is designed to offer minimal resistance to the flow of vapors into vapor receiving chamber 25.

This linear displacement motion of arm 51 is used to move valve actuator member 42 into its closed position by the use of pin 55 which transmits the motion from arm 51 to member 42. Pin 55 is located in pin housing 56 which is secured in spout 12 and has an 0-ring seal 57 between pin 55 and housing 56. No biasing means is required for pin 55 since both member 42 and arm 51 are flat springs with sufficient force to return pin 55 back to its normal position.

For purposes of latching or securing the nozzle in the fillpipe so that filling may be completed without operator assistance, extension 53 of guide collar 54 can serve as a latching point for contacting the inside lip on the end of the fillpipe to prevent the nozzle from sliding out of the fillpipe. However, other problems can occur when filling which necessitate insertion of the nozzle further into the fillpipe. Placement of a plurality of stops 58 on actuator arm 51 which acts as latching points, permits the nozzle to be held further in the fillpipe when possible, thereby increasing the probability of obtaining a better seal by the vapor receiving system. This feature also reduces the possibility of obstructing the flow of gasoline and causing premature shut off in those fillpipes having a sharp curve near its opening which deflects the gasoline in such a manner as to cover opening 32 of vent tube 31. This feature is also important when filling cars which use no-leaded gasoline. The fillpipes of these cars have a restrictor device which permits only the spouts having a smaller diameter to pass through. Often, it is necessary to insert the nozzle spout in the fillpipe further than normal to reach the restrictor device, thereby necessitating the additional latching points.

The interlock valve and its actuation mechanism are designed so that the nozzle will not operate except when the nozzle is properly inserted in the fillpipe and released so that it will rest on the end of the fillpipe. This requirement for operation assures that the nozzle is fully inserted in the fillpipe and latched in place and that the vapor receiving system should be in position against the fillpipe, if the nozzle is equipped with such a system.

If for some reason the nozzle is not properly inserted in the fillpipe, the interlock valve remains in its open position. When dispensing of gasoline is attempted, a vacuum is experienced in vent tube 31 due to the venturi in the automatic shut-off system. This vacuum draws gasoline into constriction section 43 through valve seat 45, which blocks the fluid flow through vent tube 31 and causes the automatic shut-off system to disengage lever 17.

Once the interlock valve obtains a closed position by having valve head 41 cover valve seat 45, the nozzle is free to operate in its normal fashion. The closed position is obtained by spout 12 resting on the end of the fillpipe and pressing actuator arm 51 toward spout 12 or by manual application of pressure on actuator arm 51 by the operator.

While a particular embodiment of this invention has been shown and described, it is obvious that changes and modifications can be made without departing from the true spirit and scope of the invention. It is the intention of the appended claims to cover all such changes and modifications.

The invention claimed is:

1. A nozzle for dispensing fuel into a fillpipe of a motor vehicle fuel tank and having a system for shutting off the fuel being dispensed when fuel backs up into a fillpipe and comprising:

a. a discharge spout for insertion into a fillpipe of a motor vehicle fuel tank;

b. a shut-off valve for shutting off fuel being dispensed by the nozzle;

c. actuating means for closing said shut-off valve in response to fuel backed up into a fillpipe and including a vent line extending into said discharge spout and having an open end at the discharge end of the discharge spout, said vent line being supplied with a vacuum such that when gasoline covers the open end of the vent line, the pressure in the vent line drops and the pressure drop may be sensed to actuate said shut-off valve; and d. an interlock system which prevents the dispensing of liquid through the nozzle until the discharge spout of the nozzle is properly inserted in a fillpipe, and comprising an interlock valve means coupled to the vent line, said valve means having an open position wherein the vent line is open to the inside of the discharge spout so that in the event dispensing is attempted, fuel enters the vent line causing the pressure in the vent line to drop to cause said actuating means to close said shut-off valve and having a closed position wherein the vent lint is not open to the inside of the discharge spout which permits normal operation of the nozzle, and e. means, responsive to the nozzle being properly inserted in a fillpipe, for closing said interlock valve means, whereby normal operation of the nozzle is permitted when the nozzle is properly inserted in a fillpipe.

2. The interlock system recited in claim 1 and wherein said interlock valve is coupled to the vent line at a constriction section in the vent line having a passageway with a diameter smaller than the vent line diameter and in line with the vent line whereby the smaller diameter causes a greater vacuum, relative to the vacuum in the rest of the vent line, to exist in the constriction section to draw in liquid fuel faster and also to require a smaller amount of liquid fuel to block the vent line.

3. The interlock system recited in claim 1, wherein the constriction includes means for providing fluid communication between the valve seat and the smaller diameter portion of the constriction section.

4. The interlock system recited in claim 1, in which said means for closing the interlock valve includes means for sensing the weight of the nozzle resting on the fillpipe.

5. The interlock system recited in claim 4, wherein the means for sensing the weight of the nozzle resting on the fillpipe comprises:

a. an actuator arm mounted on the lower portion of the spout of the nozzle in such a position that when the nozzle is inserted in the fillpipe a predetermined distance and released, the actuator arm will be over the edge of the fillpipe; and b. means for biasing at least part of the actuator arm away from the spout a predetermined distance.

6. The interlock system recited in claim 5, wherein the actuator arm and biasing means comprises:

a. an elongated flat spring having one end secured to the spout and having a shape so that the free end is normallly biased away from the spout a predetermined distance; and b. means, mounted to this spout, for controlling the movement of the free end of the flat spring so that it is permitted to move toward and away from the spout the predetermined distance.

7. The interlock system recited in claim 5, further comprising means, secured to the actuator arm, for latching the nozzle in the fillpipe.

* * * * *